US006742213B1

(12) United States Patent
Vaes

(10) Patent No.: US 6,742,213 B1
(45) Date of Patent: Jun. 1, 2004

(54) ERGONOMIC HANDLE

(76) Inventor: Ed Vaes, 233 Avondale Street, Hamilton, Ontario (CA), L8L 6C4

( * ) Notice: Subject to any disclaimer, the term of this patent is extended or adjusted under 35 U.S.C. 154(b) by 0 days.

(21) Appl. No.: 09/425,743

(22) Filed: Oct. 22, 1999

(51) Int. Cl.[7] ..... A46B 5/02; B25G 1/10

(52) U.S. Cl. ..... 15/143.1; 15/159.1; 15/160; D4/132; 16/430; 81/489

(58) Field of Search ..... 15/143.1, 159.1, 15/160, DIG. 4, 145, 166; 16/430; D4/132, 135, 138; 81/489

(56) References Cited

U.S. PATENT DOCUMENTS

| | | | | | |
|---|---|---|---|---|---|
| 1,004,438 | A | * | 9/1911 | King | 15/166 |
| 1,315,194 | A | * | 9/1919 | Yamamoto | 15/143.1 |
| D85,251 | S | * | 9/1931 | Lynde | D4/132 |
| D167,775 | S | * | 9/1952 | Schmidt | D4/132 |
| 2,691,552 | A | * | 10/1954 | Bauman et al. | |
| 3,276,063 | A | * | 10/1966 | Harrison | 15/171 |
| D251,160 | S | | 2/1979 | Kelly, III et al. | D4/38 |
| D255,845 | S | | 7/1980 | Wood | D4/38 |
| 4,495,669 | A | | 1/1985 | Hooper | 15/143 R |
| 4,598,437 | A | * | 7/1986 | Ernest et al. | 15/145 |
| D292,244 | S | | 10/1987 | Roberts et al. | D4/129 |
| D292,348 | S | | 10/1987 | Roberts et al. | D4/129 |
| D292,349 | S | | 10/1987 | Roberts et al. | D4/129 |
| D311,455 | S | | 10/1990 | Snipes | D4/123 |
| 5,528,792 | A | * | 6/1996 | Nazemi | 15/143.1 |
| D378,325 | S | | 3/1997 | Camp, Jr. | D4/138 |
| 5,881,421 | A | * | 3/1999 | Ducharme | 15/143.1 |
| D412,618 | S | * | 8/1999 | Parker et al. | D4/132 |
| 6,070,286 | A | * | 6/2000 | Cardarelli | 15/143.1 |
| 6,079,075 | A | * | 6/2000 | Velez-Juan | 15/143.1 |
| 6,145,151 | A | * | 11/2000 | Heron et al. | 15/143.1 |
| D441,537 | S | * | 5/2001 | Tapley et al. | D4/132 |
| D448,178 | S | * | 9/2001 | Tapley et al. | D4/132 |

FOREIGN PATENT DOCUMENTS

| | | | | |
|---|---|---|---|---|
| CH | 180027 | * | 12/1935 | 15/143.1 |

* cited by examiner

*Primary Examiner*—Gary K. Graham

(57) ABSTRACT

The present invention is an ergonomic paint brush handle including a head section having a shoulder end, a brush end, a brush edge and a shoulder surface, said brush end of said head section for receiving a brush head, and said head section being oriented substantially along a brush plane. The paint brush handle also has a longitudinal handle section oriented substantially along a handle axis, said handle axis and said brush plane are substantially parallel to each other and disposed at an offset distance. The handle also has a transition sections for rigidly connecting said shoulder end of said head section to one end of said handle section. The ergonomic handle is gripped by placing a fore finger along said brush edge, and a thumb on said shoulder surface and said handle section lying in the web of a hand between the fore finger and the thumb, such that when said handle is gripped in a hand said transition section provides relief for the web of a hand.

10 Claims, 8 Drawing Sheets

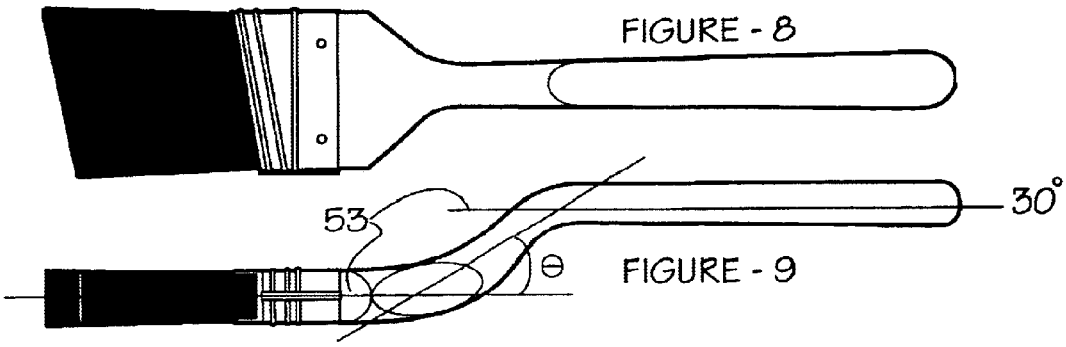
FIGURE - 8
FIGURE - 9
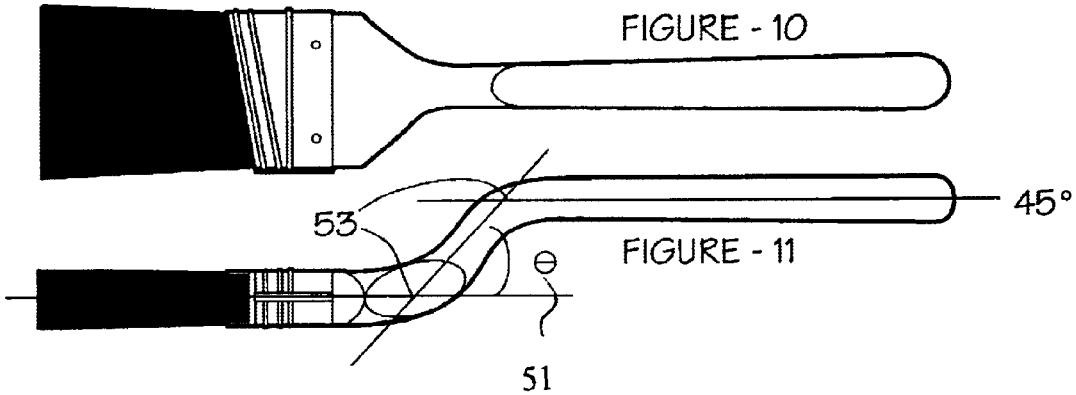
FIGURE - 10
FIGURE - 11
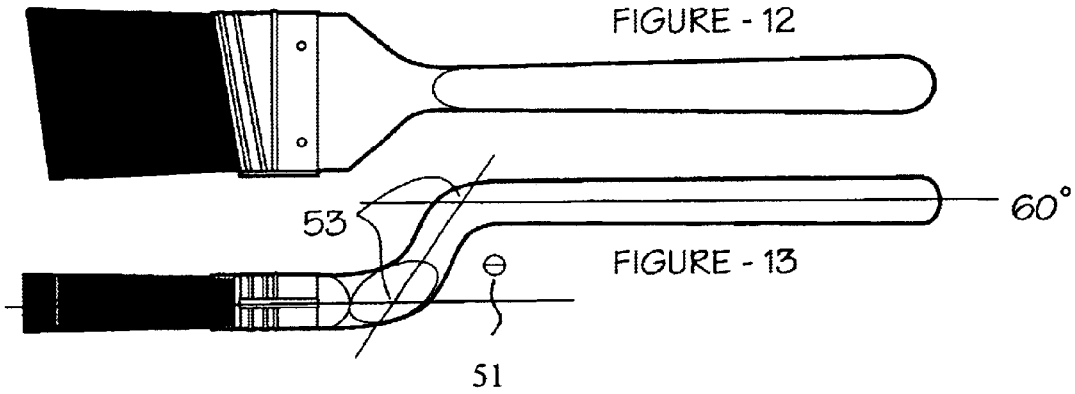
FIGURE - 12
FIGURE - 13

ERGONOMIC HANDLE

FIELD OF THE INVENTION

The present invention relates to handles and in particular relates to ergonomic handles.

BACKGROUND OF THE INVENTION

Currently paint brush handles which are commercially available, generally speaking have straight handles which are attached to a brush head including casing and bristles. The straight handle can either be gripped as shown schematically in FIG. 2 when the brush is used for trimming and/or cutting into corners,or the brush can also be clasped or held as shown schematically in FIG. 5 near the distal end of the handle when a longer reach is required and/or when large surface areas are painted which do not require exact delineation of the brush bristles.

A sash or angled bristle brush is generally used for trimming or cutting painting in order to provide a uniform edge which can follow into corners and/or around windows and/or trim of houses. When painters are trimming and/or gripping the brush as schematically shown in FIG. 2, it is important that a very steady hand hold the brush in order that a straight line or edge can be painted. In current paint brush handle designs, the web of the hand (being the portion between the thumb and the fore finger) is impinged upon by the straight handle and therefore, the hand must bend to fit around the straight handle in a very unnatural position. This can cause cramping of the hand resulting in tremors and shaking leading to poor painting quality and straightness of lines.

In order to reduce hand fatigue, a number of paint brush designs have been developed as follows.

U.S. Design Pat. No. 292,348 titled Paint Brush by Roberts et al, filed Jul. 9, 1986 depicts an ergonomic paint brush handle.

U.S. Design Pat. No. 311,455 titled Paint Brush by John Rodpass, filed Dec. 16, 1987 also depicts an ergonomic paint brush handle.

U.S. Design Pat. No. 255,845 titled Pistol Grip Brush by Wood, filed Aug. 31, 1978 depicts a paint brush handle having a pistol style grip end.

U.S. Design Pat. No. 251,160 titled Paint Brush Handle or the Like by Kelly III et al, filed Nov. 8, 1977 depicts a further ergonomic paint brush handle.

U.S. Pat. No. 4,495,669 by Hooper titled Dual-Grip Handle Brush for Painting and the Like, filed Jan. 6, 1983 describes a paint brush having a dual handle to be held in either conventional manner or with a pistol grip attachment.

The handles disclosed in the above-mentioned patents are directed at designing a handle which is be held in a manner totally different than conventional paintbrush handles. The present design incorporates a ergonomic handle design which enhances the present method of holding a paint brush by ensuring that hand fatigue is minimized while using a modified paint brush handle. The present design allows the paint brush to be held in the conventional manner as well as in a preferred manner and retains the handle centrally aligned along the paint brush. This ensures that the weight balance of the handle together with the brush is still in the proper proportion. Therefore, the current design optimizes the traditional holding position of the hand rather than provide for an entirely different way of holding a brush.

SUMMARY OF THE INVENTION

The present invention an ergonomic paint brush handle comprises a) a head section having a shoulder end, a brush end, a brush edge and a shoulder surface, said brush end of said head section for receiving a brush head, and said head section being oriented substantially along a brush plane;

b) a longitudinal handle section oriented substantially along a handle axis, said handle axis and said brush plane are substantially parallel to each other and disposed at an offset distance;

c) a transition means for rigidly connecting said shoulder end of said head section to one end of said handle section; and d) wherein said ergonomic handle for gripping by placing a fore finger along said brush edge, and a thumb on said shoulder surface and said handle section lying in the web of a hand between the fore finger and the thumb, such that when said handle is gripped in a hand said transition section provides relief for the web of a hand.

Preferably said transition means comprises a transition section rigidly attached at one end to said shoulder end of said head section, and at the other end to one end of said handle section, said transition section being oriented longitudinally along a transition axis which is disposed at an angle theta relative to said brush plane; such that when said handle is gripped in a hand said transition section provides relief for the web of a hand.

Preferably said transition section is dimensioned such that the off set distance falls within the range ½ a forefinger thickness to 3 times a forefinger thickness.

Preferably said angle theta falls within the range 30 degrees to 60 degrees.

Preferably the angle theta and the transition section length are selected such that there is just enough relief for the web of the hand such that the fore finger phalanges and meta carpal bones can align and lie substantially along the brush plane.

Preferably said transition section and said handle section project centrally from said head section such that said ergonomic handle is symmetrial about a handle plane.

Preferably said handle section is rod shaped and lying substantially longitudinally along said handle axis.

Preferably said ergonomic handle is oriented for gripping by a right hand.

Preferably said ergonomic handle is oriented for gripping by a left hand.

Preferably said head section is planar proximate said brush end and tapers toward said shoulder end.

Preferably said transition section is dimensioned to conform to the shoulder end dimensions at one end and the handle section dimensions at the other end thereby providing a smooth transition between the head section and the handle section.

BRIEF DESCRIPTION OF THE DRAWINGS

The invention will now be described by way of example only, with references to the following drawings in which:

FIG. 3 is a side elevational view of the present invention, an ergonomic handle, shown together with a brush head and a flat surface which it is lying on.

FIG. 4 the top perspective view of the present invention, an ergonomic handle, shown together with a brush head and a flat surface which it is lying on.

FIG. 8 is a top plan view of the present invention an ergonomic handle together with a brush head.

FIG. 9 is a side plan view of the present invention an ergonomic handle together with a brush head.

FIG. 10 is a top plan view of the present invention an ergonomic handle together with a brush head.

FIG. 11 is a side plan view of the present invention an ergonomic handle together with a brush head.

FIG. 12 is a top plan view of the present invention an ergonomic handle together with a brush head.

FIG. 13 is a side plan view of the present invention an ergonomic handle together with a brush head.

DETAILED DESCRIPTION OF THE PREFERRED EMBODIMENT

Definitions

Figure 2:
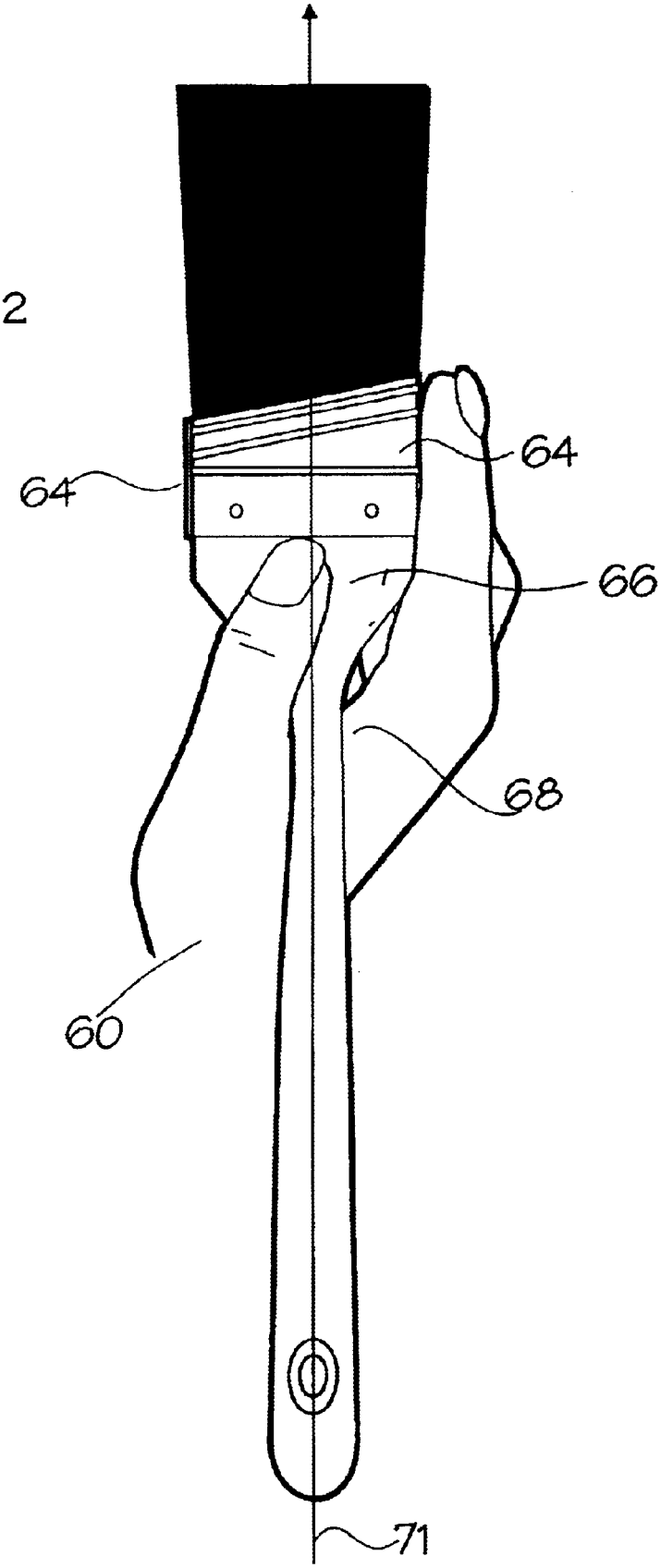
FIG. 2 is a side elevational view of the present invention, an ergonomic handle, shown together with a brush head and a hand clasping the handle.

Web: The portion of the hand located between the fore finger and the the thumb which normally impinges upon a paint brush handle when held as shown in FIG. 2.

Brush head: The portion of a paint brush normally including bristles mounted in a metal casing. The bristles normally eminate from one end of the casing and the other end of the casing is normally mounted onto a paint brush handle.

Fore finger thickness: The thickness (roughly diameter) of a forefonger at its largest point. Normally this ranges between ½ inch and 1½ inches.

The present invention, an ergonomic handle, shown generally as 20 includes a handle section 22, a transition section 24, and a head section 26. Mounted on ergonomic handle 20 is a brush head shown generally as 40 which includes a casing 28 having bristles 30 projecting therefrom. Brush head 40 is of the type generally known in the art where casing 28 is generally made of metal and or tin, and contains material within the casing to securely hold bristles 30 within the casing. The upper portion of casing 28, namely upper casing 31, is adapted to receive the brush end 27 of head section 26 of ergonomic handle 20, and is usually fastened to head section 26 either by crimping, gluing, and/or nailing. Head section 26 also has a shoulder end 29 which is connected to one end of transition section 24. As viewed in FIGS. 2 and 6 ergonomic handle 20 is preferably symettrical about handle plane 71.

Figure 1:
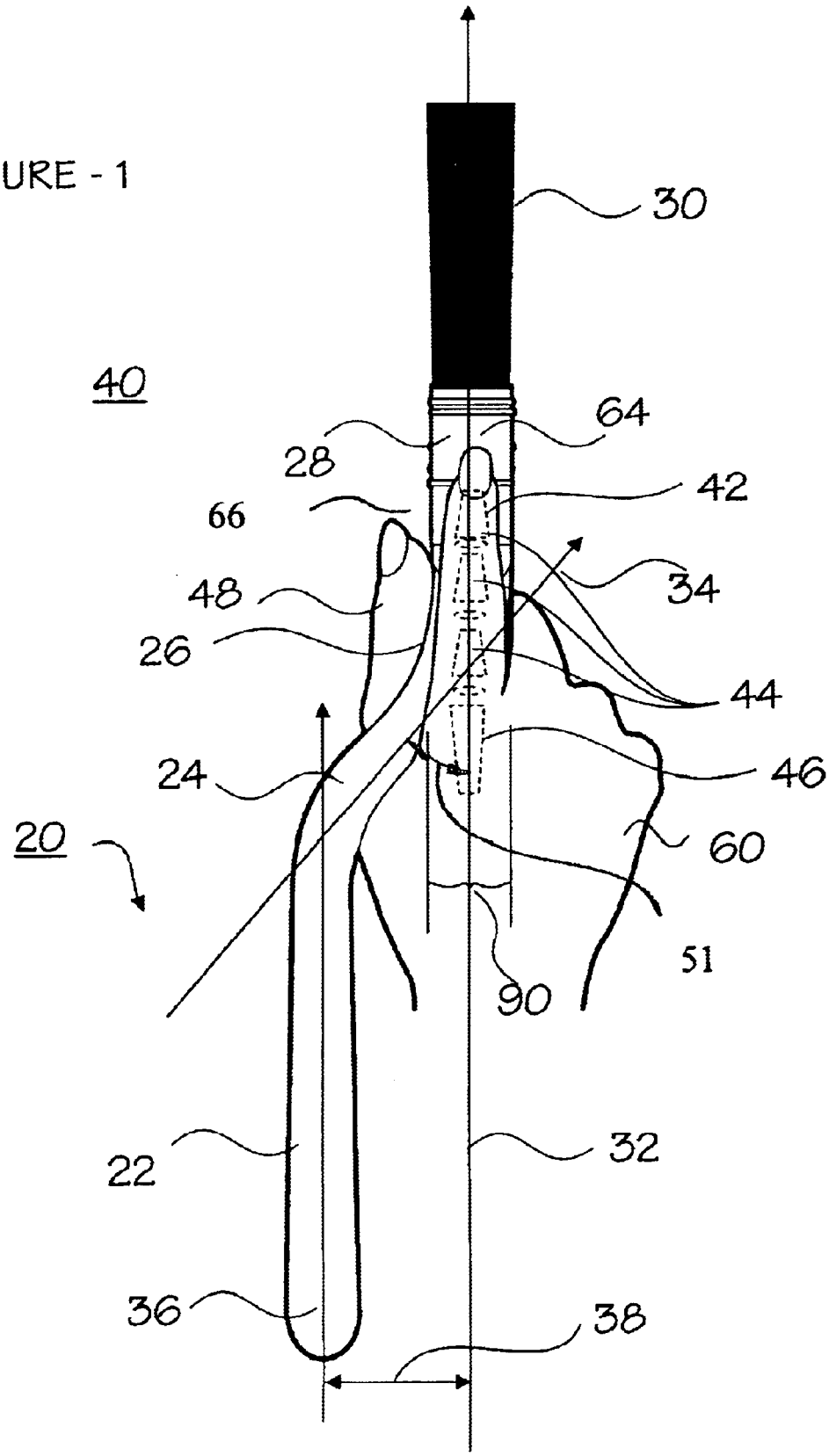
FIG. 1 is a the top plan view of the current invention, an ergonomic handle, shown together with a brush head and a hand gripping the handle.
Figure 6:
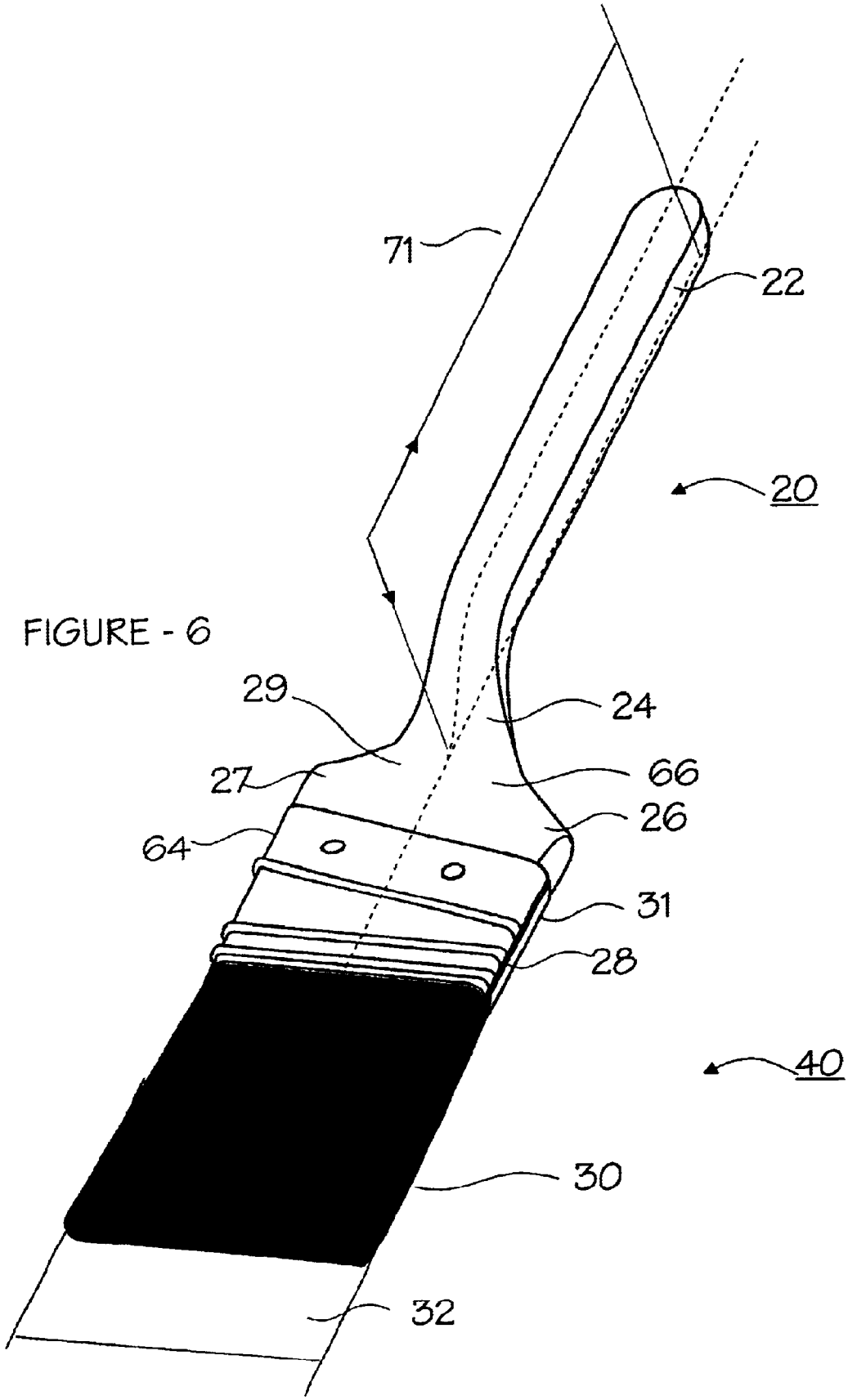
FIG. 6 is a top perspective view of the present invention an ergonomic handle together with a brush head
Figure 7:
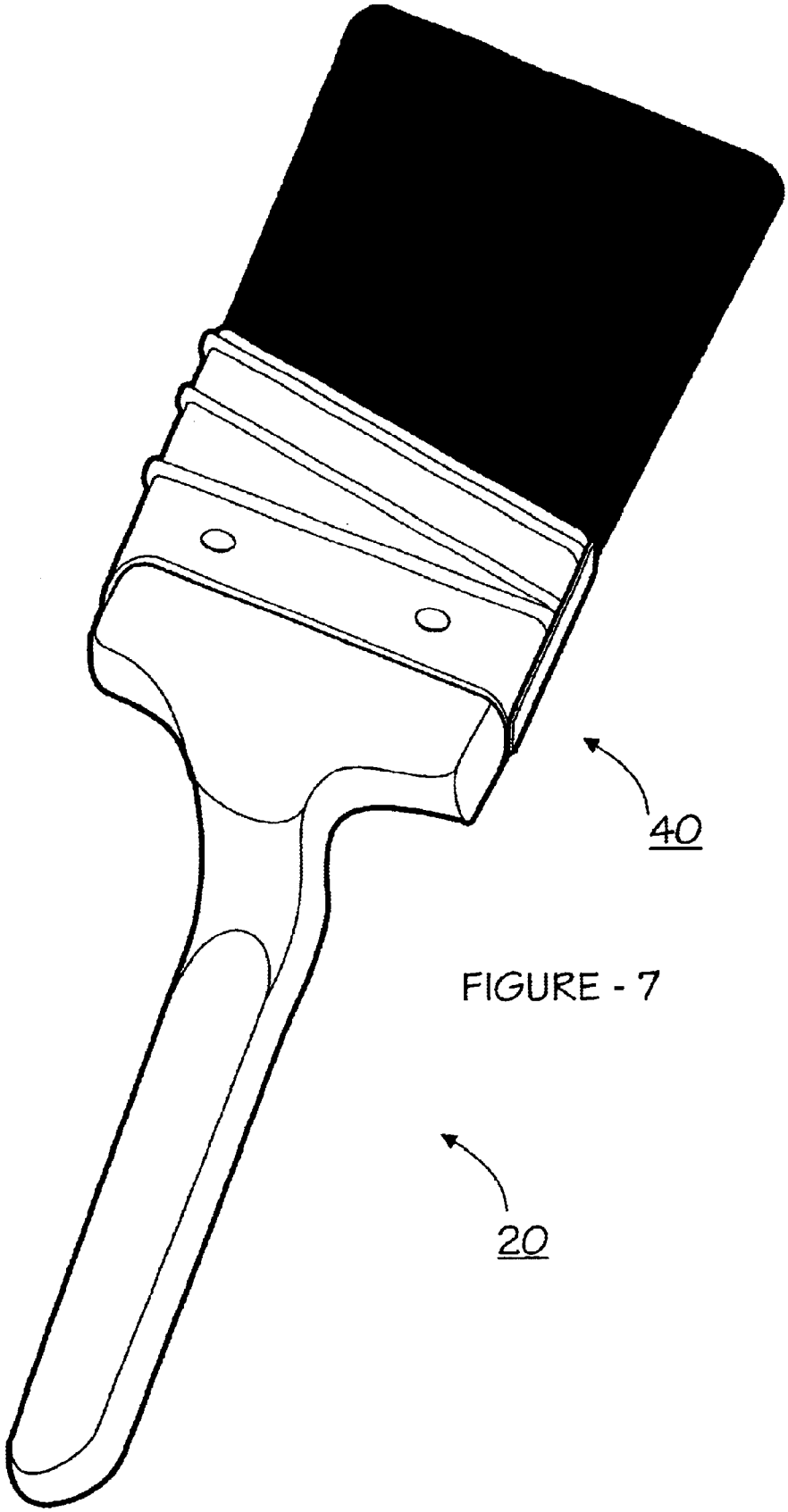
FIG. 7 is a inverted perspective view of the present invention an ergonomic handle together with a brush head.
Figure 14:
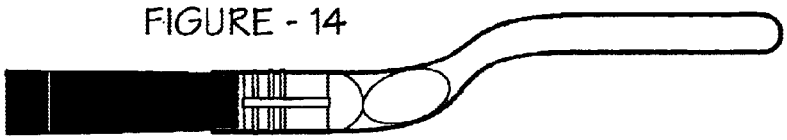
FIG. 14 is a side elevational view of the present invention an ergonomic handle together with a brush head.
Figure 15:
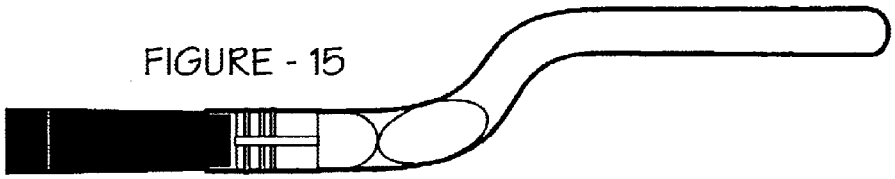
FIG. 15 is a side elevational view of the present invention an ergonomic handle together with a brush head.
Figure 16:
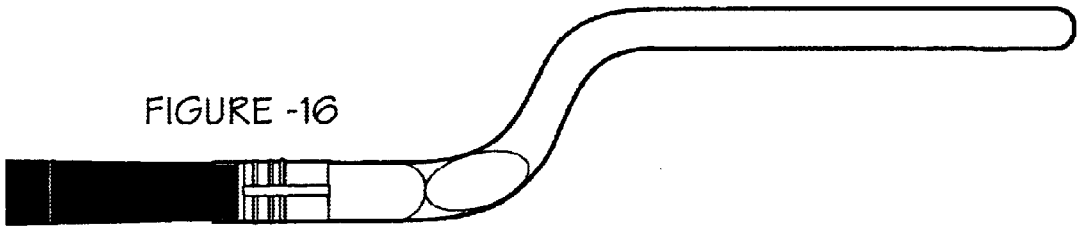
FIG. 16 is a side elevational view of the present invention an ergonomic handle together with a brush head.

Referring now to FIG. 1, the present invention ergonomic handle 20 is shown together with a hand 60 holding and gripping ergonomic handle in the preferred manner for use with this invention. Fore finger 42 is placed along brush edge 64, and thumb 48 is place upon shoulder surface 66 as best shown in FIGS. 1 and 2. By holding ergonomic handle 20 in this manner, the web oil part of hand 60 lying between fore finger 42 and thumb 48, is accommodated and relieved by transition section 24 of ergonomic handle 20. Bristles 30, casing 28, and head section 26 as shown in FIG. 6 lie substantially along brush plane 32. Transition section 24 runs at an angle with respect to brush plane 32 as shown by transition axis 34. Handle section 22 runs longitudinally along handle axis 36, as shown in FIG. 1.

Schematically shown in FIG. 1 are the bones within the hand 60, namely phalanges 44, part of fore finger 42, and metacarpals 46 which are found in the palm of hand 60. The present invention, ergonomic handle 20, minimizes the distortion of the phalanges 44 and metacarpals 46 allowing them to lie substantially along a straight line namely along brush plane 32 as shown in FIG. 1. This is accomplished by providing for relief for web 68 of hand 60 by the addition of transition section 24 to a traditional straight handle.

As best seen in FIG. 1, the distance between brush plane 32 and handle axis 36 is shown as offset distance 38. The offset distance will depend upon the angle of transition section 24, relative to the brush plane 32. In addition, the overall length of transition section 24, namely transition lenght 53, will also contribute to offset distance 38. In other words, offset distance 38 can be increased by increasing the angle between transition axis 34 and brush plane 32, namely angle theta 51, or increasing transition section length 53.

FIGS. 8–16 show variations in lenght of the transition section 24 as well as the angle between transition axis 34 and brush plane 32. By way of example only and not limiting the angles that are possible, FIG. 9 depicts a 30 degree angle theta 51 between the transition axis 34 and the brush plane 32, FIG. 11 depicts a 45 degree angle theta: 51 between the transition axis 34 and the brush plane 32, and FIG. 13 depicts a 60 degree angle theta 51 between the transition axis 34 and the brush plane 32.

In use, ergonomic handle 20 can alleviate hand strain by providing for alignment of the phalanges 44 and the metacarpals 46 along a straight brush plane 32 as depicted in FIG. 1. Commercially available brushes generally have straight handles which impinge upon web 68 of hand 60 of the user. As a result, the hand must curl around the brush handle in order to grip the head section 26 of a handle. This is an unnatural position for the hand and as a result fatigue quickly sets in to the person that is using a convonational handle. Therefore, the present design allows for a natural alignment of the bones, mainly the phalanges 44 and the metacarpals 46, thereby allowing the hand 60 to grip ergonomic handle 20 in a natural position, thereby, minimizing fatigue of the user.

Ergonomic handle 20 if preferrably gripped by placing fore finger 42 along brush edge 64 and thumb 48 on shoulder surface, thereby providing relief for web 68 by transition section 24 which projects away from web 68.

Preferably, the angle theta 51 between transition axis 34 and brush plane 32 is 45 degrees, however, as shown in FIGS. 8–19, the angle theta 51 can vary between 30 degrees and 60 degrees and still be effective. Generally speaking, the smaller the angle the larger the transition section length 53 becomes. In other words, in order to obtain the same relief for web 68 of hand 60 with a smaller angle theta 51, the longer transition length of 53 is normally required.

Almost any angle theta 51 will work, however, practically speaking the range of values which seem to work best in practice are angle theta between 30 degrees and 60 degrees.

Note that the ergonomic handle 20 design can be used with a sash brush shown in FIG. 8 or a straight brush that is shown in FIG. 10 and FIG. 2. It will be apparent to those skilled in the art that ergonomic handle 20 must be made in the left hand version and a right hand version when ergonomic handle is mated with a sash or angle type brush.

Casing 28 is just slightly larger than head section 26 and is adapted to just fit snugly over head section 26. The width of fore finger 42 is shown as thickness 90 in FIG. 1 and in practice it has been found that offset distance 38, in order to be effective as an ergonomic handle and to ensure the best alignment of the phalanges 44 and metacarpals 46 of hand 60, the offset distance 38 preferably ranges between one half the thickness 90 to three times the thickness 90. In practice the angle theta is normally chosen to be 45 degrees and the transition section length 53 is then selected to vary offset distance between one half the thickness 90, to three times the thickness 90 of fore finger 42. Preferably, offset distance 38 is two times the thickness 90 of fore finger 42.

Figure 3:
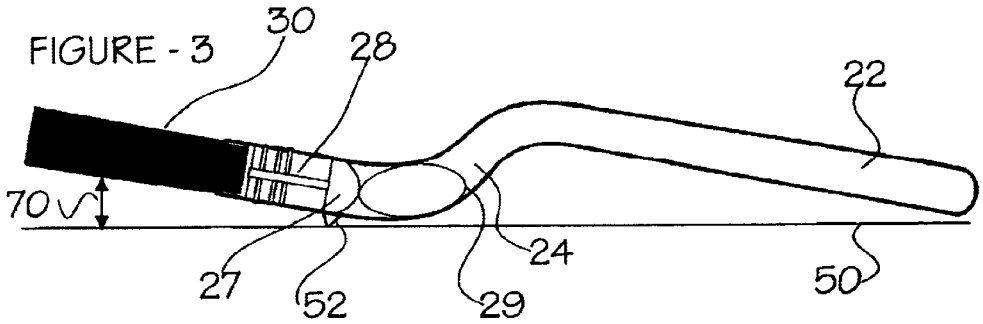
Figure 4:
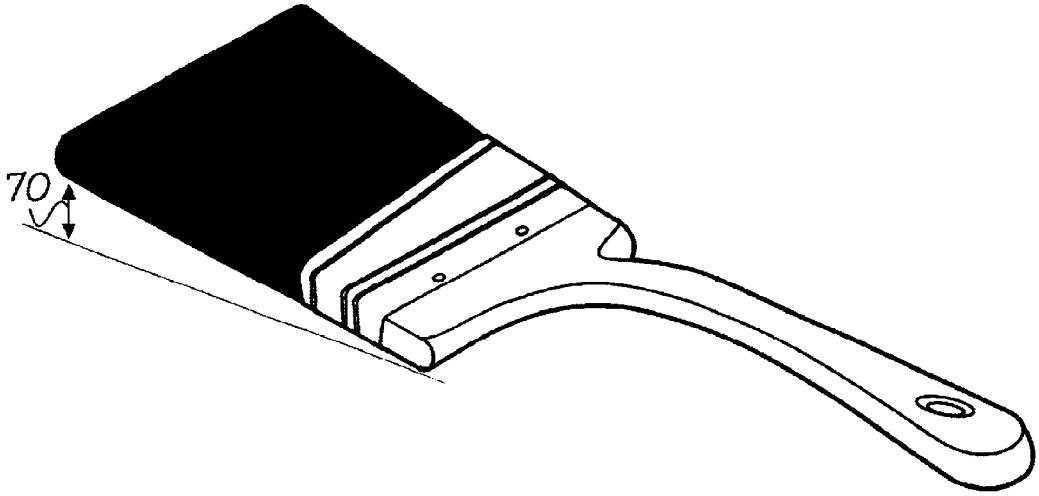

In addition to allowing hand 60 to comfortable hold ergonomic handle 20 in a manner which prevents fatigue of hand 60, by offsetting handle axis 36 from brush plane 32, one can see in FIGS. 3 and 4 by providing a pivot 52 ergonomic handle 20 when placed on a flat surface 50; bristles 30 of brush head 40 sit elevated above flat surface 50 at a height 70 above flat surface 50. A person skilled in the art, of course, will realize that the weight of handle section 22 and head section 26 must be enough to offset the weight of bristles 30 and casing 20 such that the ergonomic handle pivots preferably to the right of pivot 52 as shown in FIG. 3. To ensure that ergonomic handle 20 pivots to the right as shown in FIG. 3 elevating bristles 30 to a height 70 above flat surface 50, pivot 52 is placed at a point such that the balancing favours the lifting of bristles 30 above flat surface 50. In addition, weights can be placed within ergonomic handle to yield the correct balance. The advantage of this is when the ergonomic handle 20 together with brush head 40 is placed upon a flat surface, the bristles which may contain paint will not come in contact with flat surface 50, thereby preventing paint and/or other materials from being deposited on to flat surface 50 and/or dirt and/or dust being on Flat surface 50 being deposited upon bristles 30.

Figure 5:
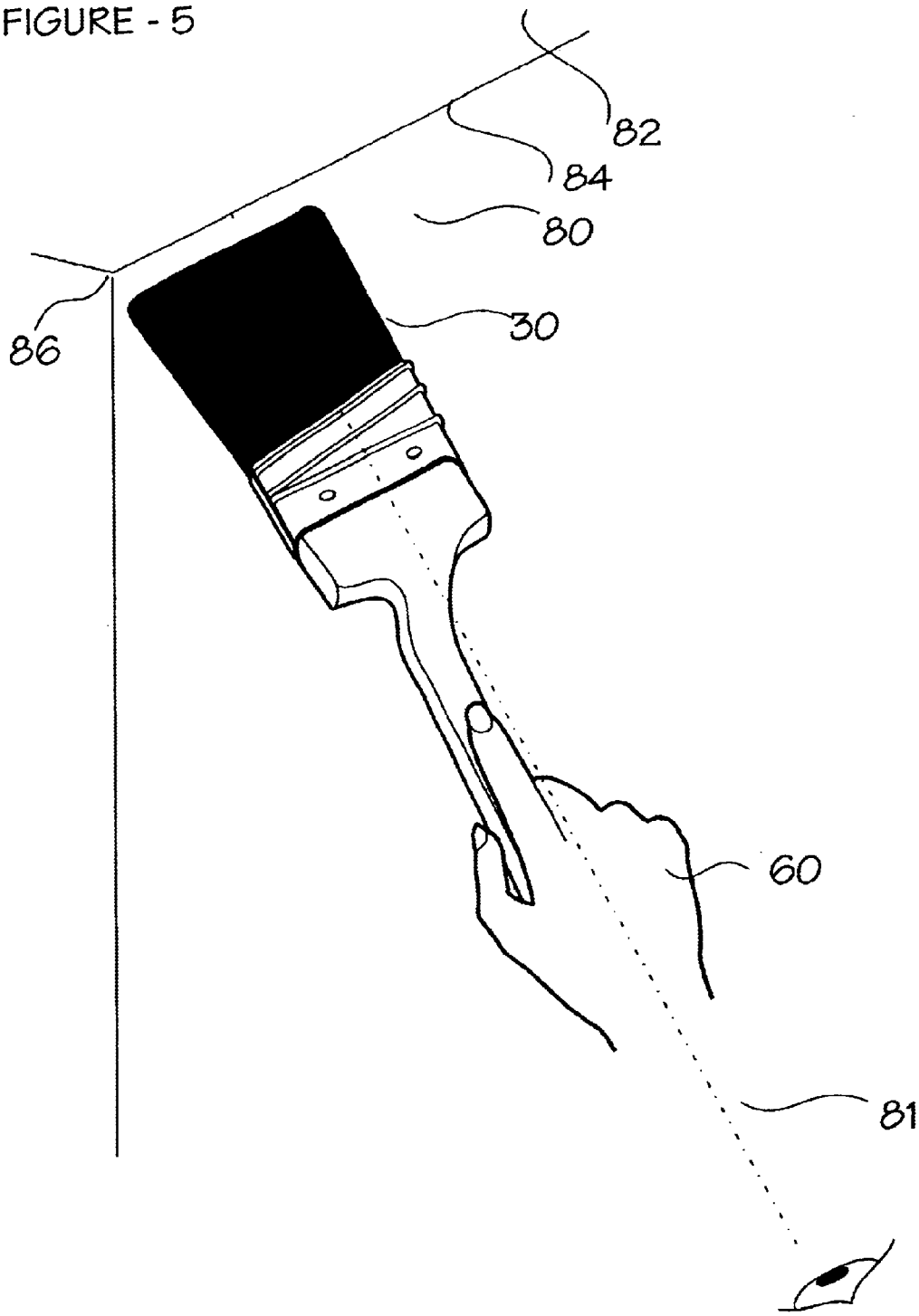
FIG. 5 is a perspective view showing the ergonomic handle in use together with a brush head and a hand clasping the end of the ergonomic handle showing schematically how the handle is used in working overhead into the corners of walls.

Referring now to FIG. 5 a further advantage offsetting handle axis 36 from brush plane 32 is obtained when painting overhead as shown in FIG. 5. FIG. 5 shows how a person is painting overhead along edge 84 of where a wall 80 meets with a ceiling 82 along edge 84. This painting operation is often called cutting and/or trimming and it is important that the user be able to see the top of bristles 30 as they move along edge 84 between the ceiling 82 and the wall 80. Again, because of the offset distance 38 between handle axis 36 and brush plane 32, hand 60 which is now holding only the handle section 22 of ergonomic handle 20 (in order to obtain the greatest reach) does not obstruct the line of site 81 as schematically shown in FIG. 5. In a prior art straight handled brush, hand 60 normally clasps a brush handle along brush plane 32, thereby elevating the knuckles of hand 60 and the back of hand 60 to obstruct the line of site 81 of the person doing the painting. By using ergonomic handle 20, offset distance 38 provides relief to the line of site 80 in the amount of offset distance 38, thereby ensuring that the user cansee the end of bristle 30 moving along edge 84.

It should accordingly, be apparent to persons skilled in the art that various modifications and adaptations of the structure described above are possible without departure from the spirit of the inventions, the scope of which is defined in the appended claims.

I claim:

1. A paint brush handle comprising:

a) a head section including a shoulder end, a brush end, a brush edge and a shoulder surface, said brush end of said head section for receiving a brush head, and said head section being substantially planar and oriented along a brush plane;

b) an elongated handle section oriented substantially along a handle axis and handle plane, said handle axis and said brush plane are substantially parallel to each other and spaced at an offset distance;

c) a transition means for rigidly connecting said shoulder end of said head section to one end of said handle section; and d) wherein said head section being flared, such that said head section being wider proximate said brush end and narrowing toward said transition means.

2. A paint brush handle comprising:

a) a head section including a shoulder end, a brush end, a brush edge and a shoulder surface, said brush end of said head section for receiving a brush head, and said head section being substantially planar and oriented along a brush plane;

b) an elongated handle section oriented substantially along a handle axis and handle plane, said handle axis and said brush plane are substantially parallel to each other and spaced at an offset distance;

c) a transition means for rigidly connecting said shoulder end of said head section to one end of said handle section; and d) wherein said transition means tapering, being wider proximate said head section and narrower proximate said handle section.

3. The paint brush handle claimed in claim 1 or 2 wherein said handle section being substantially oblong in cross section, with the longer oblong portion substantially parallel to said brush plane.

4. The paint brush handle claimed in claim 1 or 2 wherein said handle section being substantially elliptical in cross section, with the longer elliptical portion substantially parallel to said brush plane.

5. The ergonomic paint brush handle claimed in claim 1 or 2 wherein said transition means comprises a transition section rigidly attached at one end to said shoulder end of said head section, and at the other end to one end of said handle section, said transition section being oriented longitudinally along a transition axis which is disposed at an angle theta relative to said brush plane.

6. A paint brush comprising:

a) a handle and an attached brush head;

b) said handle including a head section including a shoulder end, a brush end, a brush edge and a shoulder surface, said brush end of said head section for receiving the brush head, and said head section being substantially planar and oriented along a brush plane;

c) said handle including an elongated handle section oriented substantially along a handle axis and handle plane, said handle axis and said brush plane are substantially parallel to each other and spaced at an offset distance;

d) said handle including a transition means for rigidly connecting said shoulder end of said head section to one end of said handle section; and e) wherein said head section being flared, such that said head section being wider proximate said brush end and narrowing toward said transition means.

7. A paint brush comprising:

a) a handle and an attached brush head;

b) said handle including a head section including a shoulder end, a brush end, a brush edge and a shoulder surface, said brush end of said head section for receiving the brush head, and said head section being substantially planar and oriented along a brush plane;

c) said handle including an elongated handle section oriented substantially along a handle axis and handle plane, said handle axis and said brush plane are substantially parallel to each other and spaced at an offset distance;

d) said handle including a transition means for rigidly connecting said shoulder end of said head section to one end of said handle section; and e) wherein said transition means tapering, being wider proximate said head section and narrower proximate said handle section.

8. The paint brush claimed in claim 6 or 7 wherein said handle section being substantially oblong in cross section, with the longer oblong portion substantially parallel to said brush plane.

9. The paint brush claimed in claim 6 or 7 wherein said handle section being substantially elliptical in cross section, with the longer elliptical portion substantially parallel to said brush plane.

10. The paint brush claimed in claim 6 or 7 wherein said transition means comprises a transition section rigidly attached at one end to said shoulder end of said head section, and at the other end to one end of said handle section, said transition section being oriented longitudinally along a transition axis which is disposed at an angle theta relative to said brush plane.

* * * * *